United States Patent [19]

Okino

[11] Patent Number: 4,552,115

[45] Date of Patent: Nov. 12, 1985

[54] AIR-FUEL RATIO CONTROL MEANS FOR INTERNAL COMBUSTION ENGINES

[75] Inventor: Yoshinori Okino, Hiroshima, Japan

[73] Assignee: Mazda Motor Corporation, Hiroshima, Japan

[21] Appl. No.: 599,973

[22] Filed: Apr. 13, 1984

[30] Foreign Application Priority Data

Apr. 14, 1983 [JP] Japan ..... 58-66226

[51] Int. Cl.[4] ..... F02D 5/00

[52] U.S. Cl. ..... 123/489

[58] Field of Search ..... 123/489, 440

[56] References Cited

U.S. PATENT DOCUMENTS 4,224,910 9/1980 O'Brien ..... 123/489

4,241,710 12/1980 Peterson Jr. et al. ..... 123/489

4,445,482 5/1984 Hasegawa et al. ..... 123/489

FOREIGN PATENT DOCUMENTS 55-96339 7/1980 Japan .

*Primary Examiner*—Andrew M. Dolinar

*Attorney, Agent, or Firm*—Fleit, Jacobson, Cohn & Price

[57] ABSTRACT

An air-fuel ratio control system for an internal combustion engine wherein a control unit is provided for producing a basic fuel quantity signal based on an engine operating condition. The system includes a feedback system including an $O_2$ sensor provided in the engine exhaust passage for producing an ON-OFF type signal based on the oxygen content in the engine exhaust gas. The control unit produces a feedback signal which is based on the signal from the $O_2$ sensor. The control unit further performs a learning control by providing supplementary signals periodically based on the average value of the feedback control signal and the gain of the feedback control is decreased as the learning progresses.

9 Claims, 8 Drawing Figures

CLC←CLC+$\overline{CFB}$ x K
S13
23
NLC←NLC+1
S14
CLEAR LEARNING COUNTER
S15
C
MEASURE OUTPUT Vo2 OF AIR-FUEL RATIO DETECTOR
S16
S17
b<Vo2<c
YES
NO
S19
S18
to2←to2+1
RESET TIMER to2
S20
to2≥tm ?
YES
NO
A
S3
IS IN HEAVY LOAD RANGE?
NO
YES
S21
NLC←1/2 x NLC
FUEL INJECTION PULSE T
T=TB(1+CFB+CLC)
S22
24
S4
OUTPUT FUEL INJECTION PULSE FOR HEAVY LOAD OPERATION
B

AIR-FUEL RATIO CONTROL MEANS FOR INTERNAL COMBUSTION ENGINES

The present invention relates to air-fuel ratio control means for internal combustion engines and, more particularly, to air-fuel ratio control means of the feedback type wherein the actual air-fuel ratio is compared with a desired value of the air-fuel ratio to thereby produce a feedback control signal.

Conventional air-fuel ratio control means of this type includes an air-fuel ratio detecting element such as an $O_2$ sensor which switches from an ON state to an OFF state and vice versa at the stoichiometric value of the air-fuel ratio by detecting the oxygen content in the exhaust gas. An operation circuit is provided for calculating the basic fuel supply quantity for the actual engine operating condition. The output signal from the air-fuel ratio detecting element is used to modify the basic fuel supply signal so that a desired air-fuel ratio is obtained. For example, when the detecting element produces an output signal which shows that the air-fuel mixture is leaner than the desired ratio, the basic fuel supply signal is repeatedly added with modifying or feedback signals to increase the fuel supply until the output of the detecting element is inverted and becomes to show that the air-fuel mixture is richer than the desired ratio. Then, the basic fuel supply signal is repeatedly subtracted with modifying signals to decrease the fuel supply. By repeating such controls, it is possible to maintain the air-fuel ratio of the mixture in the vicinity of the desired value. The sensitivity or the rate of change of fuel supply in such control system is dependent on the value of the modifying signal, which may therefore be referred as the "control gain" of the system.

In this type of control, when the engine operating condition is changed from one to another, the fuel supply control is started with the basic fuel supply signal calculated on the new engine operating condition and the basic signal is modified in accordance with the output signal from the detecting element as described previously. It should however be noted that the basic fuel supply signal may be deviated by a substantial amount from an optimum value which is appropriate for obtaining the desired air-fuel ratio, due for example to a prolonged use of the engine, so that it may sometimes take a long time before the fuel supply signal is modified beyond the optimum value and the output signal from the detecting element is inverted.

In view of the foregoing problems in the conventional control system, there has been proposed for example by the Japanese patent application No. 54-3322 filed on Jan. 13, 1979 and disclosed for public inspection on July 22, 1980 under the disclosure number of No. 55-96339 to provide a so called "learning control" system wherein operations are performed for each of various engine operating regions to obtain a basic fuel supply signal as well as an average value of fuel supply in the specific engine operating region, the average value being used to correct the basic fuel supply signal to a more appropriate value so that the fuel supply control is started with the corrected basic fuel supply signal when the engine operating condition comes to fall in the specific operating range. With this control, the air-fuel ratio can be brought to a desired value sooner than in a system wherein the fuel supply control is started with the uncorrected basic fuel supply signal. It should however be noted that the control system as proposed by the Japanese application is not satisfactory in respect of the responsive characteristics and the stability of the control.

With a large value of the control gain, it is possible to decrease the time required for having the output of the detecting element inverted, however, there will be an increased possibility of producing hunting of the control so that the control may become instable. On the other hand, where the control gain is too small, there will not be a risk of producing hunting, so that the control will become stable; however, there will be an increase in the time for having the output of the detecting element inverted so that the response characteristics of the control system will become too slow. Thus, in conventional control systems, the control gain has been determined from the viewpoint of obtaining an appropriate balance between the response characteristics and the stability of the control so that the control has not been completely satisfactory in respect either of the response characteristics or stability.

It is therefore an object of the present invention to provide an engine fuel supply control system which is satisfactory in respect both of the response characteristics and control stability.

Another object of the present invention is to improve an engine fuel supply control system of the learning control type.

A further object of the present invention is to provide an engine fuel supply control system of the learning control type wherein the control gain is changed in accordance with the progress of the study.

According to the present invention, the above and other objects can be accomplished by an air-fuel ratio control system for an internal combustion engine comprising air-fuel ratio detecting the means for detecting air-fuel ratio of the mixture supplied to the engine to produce an air-fuel ratio signal, engine operating condition detecting means for detecting an operating condition of the engine to produce an engine operating condition signal, basic fuel quantity setting means responsive to said engine operating condition signal for determining a basic quantity of fuel supply under a specific engine operating condition and producing a basic fuel quantity signal, control gain memorizing means having memories of at least one control gain, feedback control means responsive to said air-fuel ratio signal and the control gain for producing a feedback control signal for modifying the basic fuel quantity signal so that the air-fuel ratio of the mixture is changed toward a desired value, supplementary signal producing means for producing based on said feedback control signal a supplementary signal for supplementing said basic fuel quantity signal, fuel supply control means for controlling the quantity of fuel supplied to the engine in accordance with the basic fuel quantity signal, the feedback control signal and the supplementary signal, and control gain modifying means for decreasing the control gain from said control gain memorizing means in response to an increase in the number of times wherein said supplementary signals are produced. According to the features of the present invention, the control gain is decreased in response to an increase in the number of times the supplementary signals are produced, or, in other words, in response to the progress of learning of the feedback control signal so that it is possible to decrease overshooting or hunting of the control. Even though the control gain is thus decreased, it is possible to ensure an adequate response rate because the supplementary signal is already set to an appropriate value at this stage, and there will be no substantial difference between a desired value of the fuel supply and the fuel supply quantity which is determined by the basic fuel quantity signal and the supplementary signal. The supplementary signal may be determined in terms of an average value of positive and negative peak values of the feedback control signals previously obtained for the same discrete region of the operating conditions.

The above and other objects and features of the present invention will become apparent from the following descriptions of a preferred embodiment taking reference to the accompanying drawings, in which.

Figure 1:
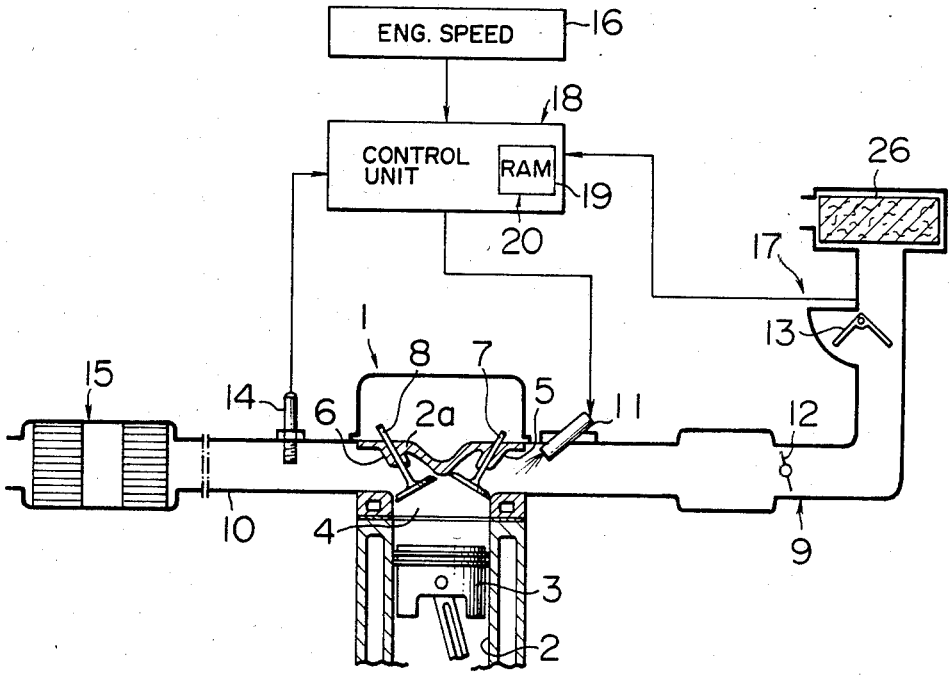
FIG. 1 is a diagrammatical sectional view of an engine having an air-fuel ratio control system in accordance with the present invention.

Referring to the drawings, and particularly to FIG. 1, there is shown an engine 1 including a cylinder 2 having a cylinder head 2*a* attached to the top end of the cylinder 2. In the cylinder 2, there is a piston 3 which reciprocates axially and defines with the cylinder 2 and the cylinder head 2*a* a combustion chamber 4 of variable volume. The cylinder head 2*a* is formed with an intake port 5 and an exhaust port 6, which are associated with an intake valve 7 and an exhaust valve 8, respectively. The intake port 5 is connected with an intake passage 9 whereas the exhaust port 6 is connected with an exhaust passage 10.

In the intake passage 9, there is provided a fuel injection valve 11 located in the vicinity of the intake port 5. The intake passage 9 further has a throttle valve 12 and an air-flow detector 13 which is located upstream of the throttle valve 12. At the upstream end of the intake passage 9, there is an air cleaner 26. In the exhaust passage 10, there is an air-fuel ratio detector which is in this embodiment an $O_2$ sensor 14 for detecting oxygen content in the engine exhaust gas. Further, the exhaust passage 10 is provided with a catalytic device 15 as well known in the art. The engine 1 is further provided with an engine speed detector 16 which together with the air-flow detector 13 constitutes an engine operating condition detecting device 17.

The fuel injection valve 11 is connected with a fuel supply source (not shown) and supplied with fuel under a controlled pressure. The valve 11 is of the duty factor solenoid type in which the quantity of fuel injected through the valve 11 is determined by the duty factor of electric pulses applied to the valve 11. In order to actuate the valve 11 and control the quantity of fuel supplied to the engine 1, there is provided a control unit 18 which may be a microprocessor of a conventional type.

The control unit 18 is connected with outputs of the detectors 13, 14 and 16 and produces output pulses which are applied to the fuel injection valve 11. The control unit 18 functions to calculate the quantity of fuel to be supplied to the engine on the basis of the engine operating condition as detected by the detectors 13 and 16 so that a desired air-fuel ratio is established. For example, in a normal engine operating condition, it is preferred to maintain the stoichiometric air-fuel ratio so that the control unit 18 produces a basic fuel quantity signal which corresponds to the fuel quantity required for providing an air-fuel mixture of the stoichiometric ratio. It should however be noted that due to various reasons it is impossible to establish the stoichiometric air-fuel ratio simply by the calculation of the control unit 18. Thus, the fuel supply system in FIG. 1 includes a feedback control comprising the $O_2$ sensor 14.

Figure 2:
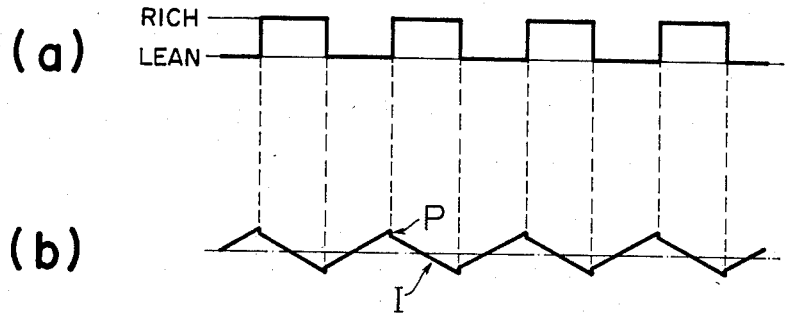
FIG. 2 is a diagram showing an air-fuel ratio signal and a feedback control signal.

As shown in FIG. 2(*a*), the $O_2$ sensor 14 produces a high level signal when the mixture is richer than the stoichiometric value and a low level signal when the mixture is leaner than the stoichiometric value.

As shown in FIG. 2(*b*), the control unit 18 produces a feedback control signal which increases with a gradient I when the low level signal is produced by the $O_2$ sensor 14 but decreases when the high level signal is produced. When the feedback signal is increased under the low level signal from the $O_2$ sensor 14 and the signal from the sensor 14 is inverted to high level, the feedback signal is stepwisely decreased by a value P as shown in FIG. 2(*b*) and then gradually decreased. Similarly, when the signal from the $O_2$ sensor 14 is inverted from high level to low level, the feedback signal is step-wisely increased by the value P and then gradually increased. The values I and P have influences on the response characteristics of the system so that they may be considered together as the control gain.

Figure 3:
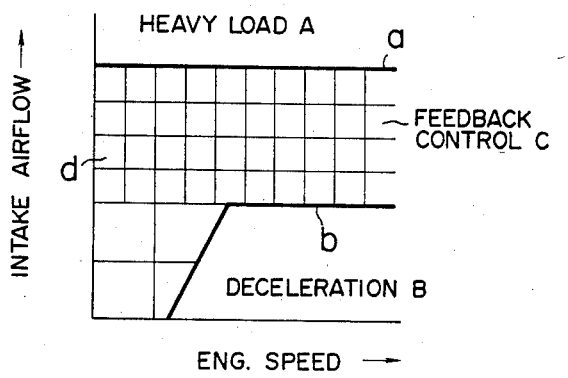
FIG. 3 shows control maps used in the air-fuel control system.

The control unit 18 includes a random access memory (RAM) 19 which has three control maps storing memories for control gains, for supplementary signals and for the progress of learning. In FIG. 3, there is shown the control map for the control gains. In the map, the engine operating range is divided into three zones, one being a heavy load zone A having intake air flow greater than a predetermined value a, the second being a deceleration zone B defined by a line b, the third being a feedback zone c between the lines a and b. The feedback zone c is divided into a plurality of discrete regions d, and, for each discrete region, there are stored memories for the values I and P. In the heavy load zone A, there is memorized a heavy load modifying factor which may for example a value 1.2 which is multiplied to the basic fuel quantity signal to provide an increased fuel supply for heavy load operation. In the deceleration zone B, fuel supply may be cut.

The map for the supplementary signals has the same discrete regions in the feedback control zone as in the previously described map and in each discrete region there is a memory for the supplementary signal. The map for the progress of learning also has the same discrete regions in the feedback control zone and in each discrete region there is a memory for the progress of learning, that is, the number of times wherein the supplementary signals are produced for the operation in that discrete region.

Figure 4A:
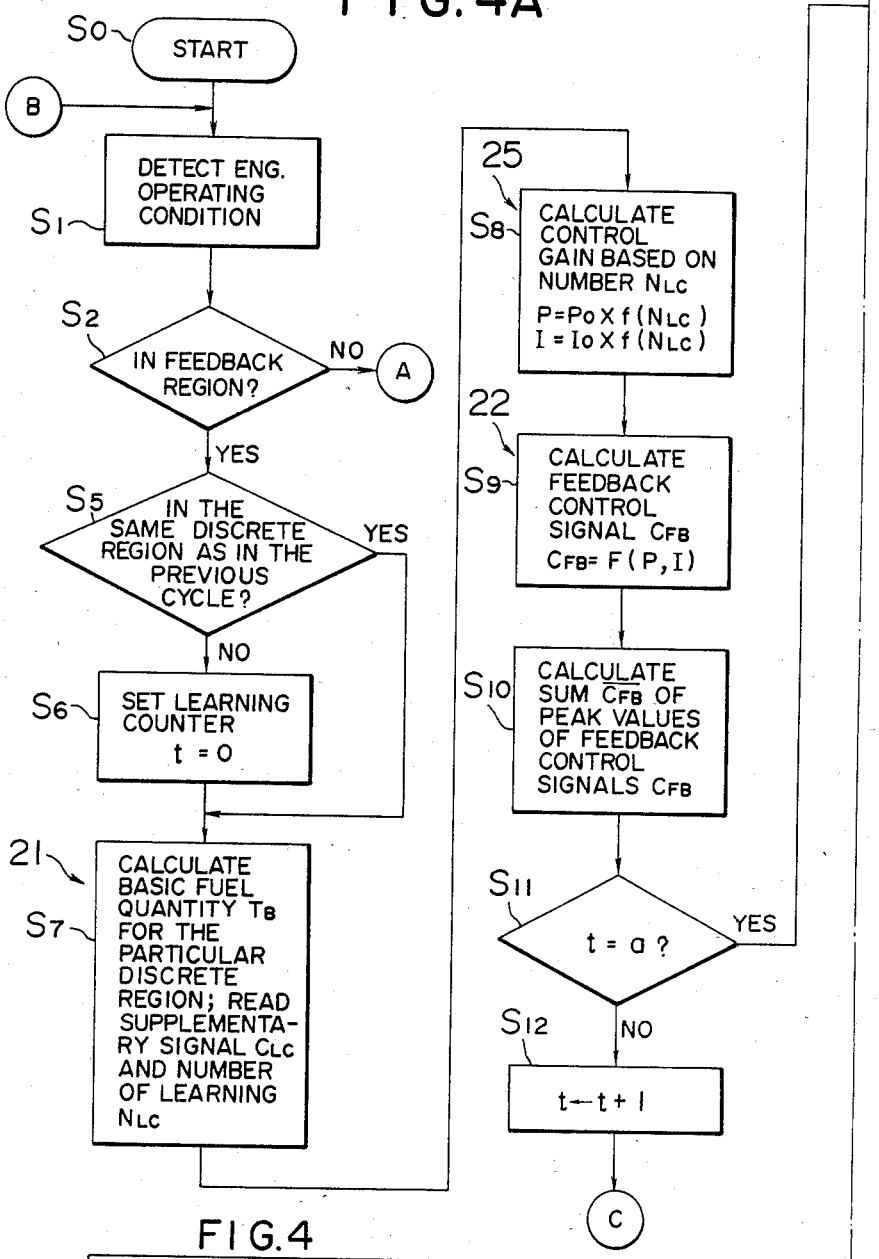
FIGS. 4, 4A and 4B are a program flow chart showing the operation of the control unit.
Figure 4:
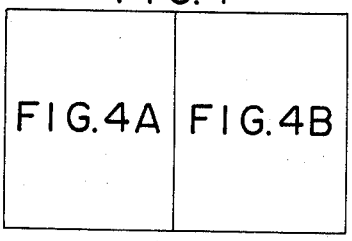
Figure 4B:
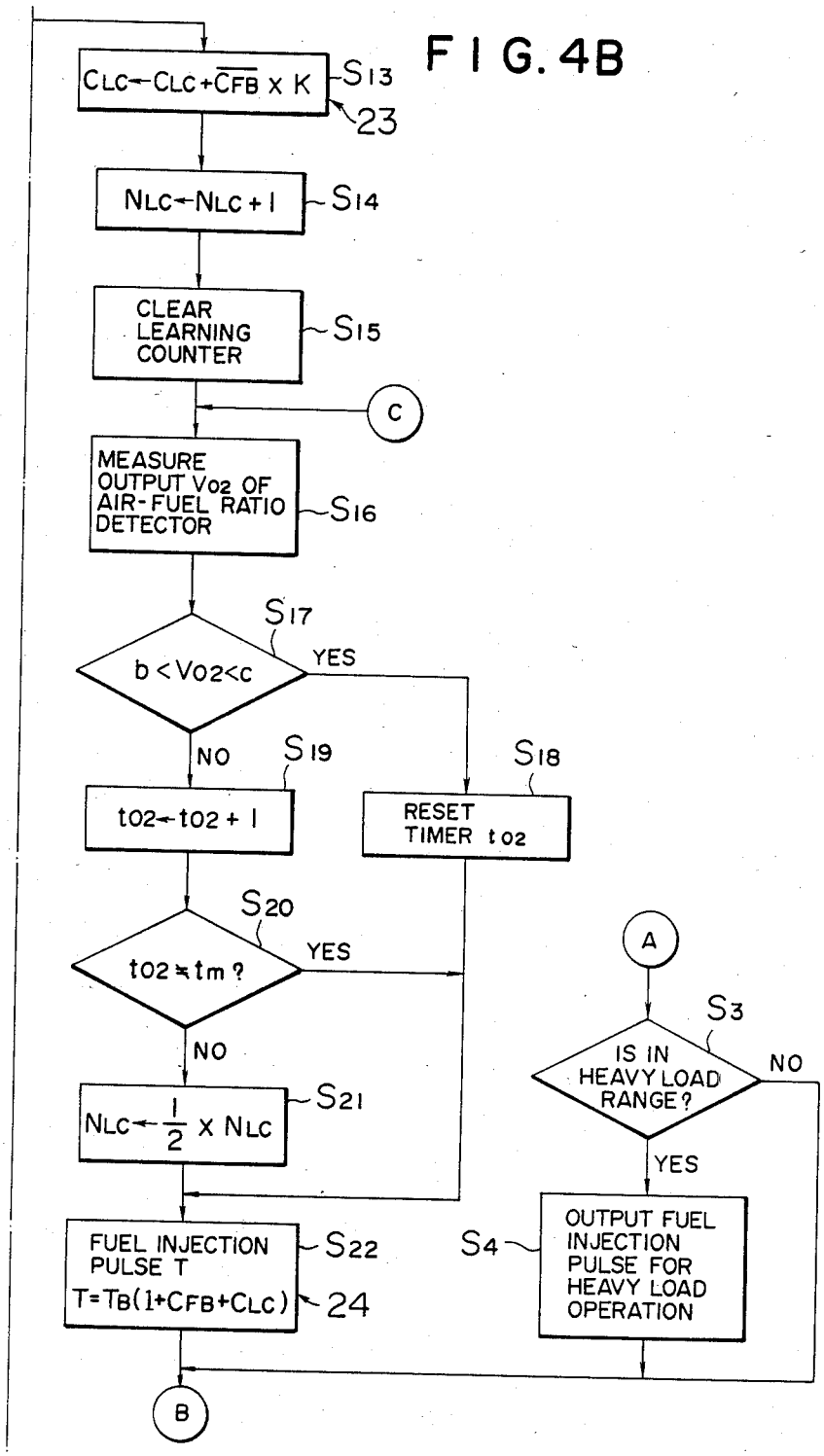

Referring now to FIG. 4 which shows the functions of the control unit 18, the control unit 18 at first detects in step $S_1$ the engine operating condition based on the airflow signal and the engine speed signal from the detectors 13 and 16, respectively, and then judges in step $S_2$ whether or not the engine operating condition is in the feedback control zone C. When it is judged that the engine operating condition is not in the feedback control zone C, a further judgement is made in step $S_3$ as to whether the operating condition is in the heavy load zone A. Where the result of the judgement is YES, the control unit 18 produces in step $S_4$ fuel injection pulses of an appropriate duty factor for the heavy load operation. If the result of the judgement is NO, however, it is deemed that the engine is under deceleration and the control unit 18 does not produce any output so that the fuel supply is cut.

Figure 5:
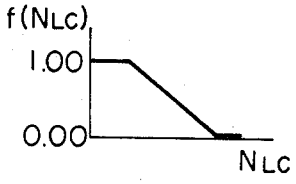
FIG. 5 is a diagram showing the learning control coefficient.
Figure 6:
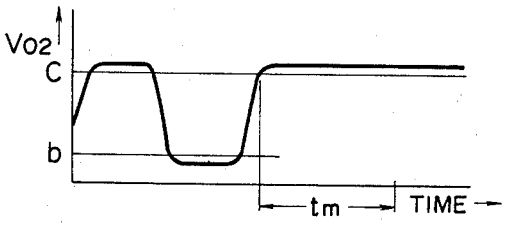
FIG. 6 is a diagram showing an example of change of the output from the air-fuel ratio detecting element.

When it is judged in the step $S_2$ that the engine operating condition is in the feedback zone C, a further judgement is made in step $S_5$ as to whether or not the discrete region in the feedback zone C in which the operating condition falls is the same as the discrete region in which the operating condition fell in the previous checking cycle. Where the result of the judgement is YES, a further step $S_7$ is carried out. When the result of the judgement is NO, the learning counter is set to zero and the step $S_7$ is carried out. In the step $S_7$, a calculation is made based on the airflow signal and the engine speed signal from the detectors 13 and 16, respectively, to determine the duty factor of the basic fuel quantity pulse $T_B$. Further, in the step $S_7$, the supplementary signal $C_{LC}$ and the number of learning cycles $N_{LC}$ for the specific discrete region in which the operating condition falls are read from the respective control maps. Then, the values Po and Io for the specific discrete region are read in step $S_8$ and calculation is made based on the number of learning cycles $N_{LC}$ in accordance with the function as shown in FIG. 5. More specifically, as the learning control progresses or the number of learning cycles $N_{LC}$ increases, the values P and I are decreased. Thereafter, a calculation is made in step $S_9$ to obtain a feedback control signal $C_{FB}$ as a function of the values P and I as shown in FIG. 2(*b*). For example, where a low level signal is produced by the $O_2$ sensor 14, the value of the feedback control signal $C_{FB}$ as obtained in the previous checking cycle is multiplied with an appropriate factor corresponding to the control gain I to obtain a new feedback control signal $C_{FB}$ which is increased in accordance with the control gain I.

The control unit 18 has a memory which memorizes positive and negative peak values of the feedback control signals $C_{FB}$ for each of the discrete regions of the engine operation and performs a calculation in step $S_{10}$ to obtain a sum $C_{FB}$ of the peak values of the feedback control signals $C_{FB}$. Then, a judgement is made as to whether the counted number in the learning counter is equal to or less than a predetermined number a. Where the counted number is less than the number a, the count in the learning counter is increased by one and the control proceeds to step $S_{16}$. Where the count is equal to the number a, a calculation of a supplementary signal $C_{LC}$ is performed in step $S_{13}$. In this step, an average value of the peak values of the feedback control signals $C_{FB}$ is obtained by multiplying the reciprocal K of the number of the peaks of the signals $C_{FB}$ by the sum $C_{FB}$ and the average value is added to the previously obtained supplementary signal $C_{LC}$. Thereafter, the memory of the number of learning cycle $N_{LC}$ is increased by one in step $S_{14}$ and the new number is memorized. Then, the learning counter is cleared in step $S_{15}$ and the control proceeds to step $S_{16}$. It will therefore be understood that the learning of the previously obtained feedback signals is carried out whenever the checking cycles are repeated by the predetermined number a.

In the step $S_{16}$, measurement is made of the value $Vo_2$ of the output of the $O_2$ sensor 14 and a judgement is made in step $S_{17}$ as to whether the measured value $Vo_2$ is between predetermined values b and c. Where the result of the judgement is YES, the timer $to_2$ is reset to zero and advanced to step $S_{22}$. However, where the result of judgement is NO, the count of the timer $to_2$ is advanced by one in step $S_{19}$ and a judgement is made in step $S_{20}$ as to whether the count in the timer $to_2$ is not equal to a predetermined time tm. If the result is YES, the step $S_{22}$ is carried out. However, if the result is NO, it is judged that the number $N_{LC}$ of the learning control is inappropriate and the number $N_{LC}$ is multiplied by $\frac{1}{2}$ to thereby increase the control gains P and I. This situation may occur when the characteristics of the fuel injection system has been changed for example by replacing the fuel injection valve 11.

In the step $S_{22}$, calculation is made of the fuel injection pulse T in accordance with the formula $T=T_B(1+C_{FB}+C_{LC})$ and the pulse T is applied to the fuel injection valve 11. In this system, feedback control is carried out by adding the feedback control signal $C_{FB}$ which is determined in accordance with the output signal from the $O_2$ sensor 14 and, based on the learning of the feedback control signals, a supplementary signal $C_{LC}$ is produced and added to the basic fuel quantity signal. Therefore, the control of the fuel supply is started in each discrete region of the engine operation with the basic fuel quantity signal added with the supplementary signal which is determined to bring the fuel supply to the most appropriate value, so that the feedback control is carried out very effectively. Further, the control gain for the feedback control is decreased as the learning of the feedback signal progresses so that more stable control can be accomplished.

The invention has thus been shown and described with reference to a specific embodiment, however, it should be noted that the invention is in no way limited to the details of the illustrated arrangements but changes and modifications may be made without departing from the scope of the appended claims.

I claim:

1. An air-fuel ratio control system for an internal combustion engine comprising: air-fuel ratio detecting means for detecting the air-fuel ratio of a mixture supplied to the engine to produce an air-fuel ratio signal, engine operating condition detecting means for detecting an operating condition of the engine to produce an engine operating condition signal, basic fuel quantity setting means responsive to said engine operating condition signal for determining a basic quantity of fuel supply under a specific engine operating condition and producing a basic fuel quantity signal, control gain memorizing means having memories of at least one control gain, feedback control means responsive to said air-fuel ratio signal and the control gain for producing a feedback control signal for modifying the basic fuel quantity signal so that the air-fuel ratio of the mixture is changed toward a desired value, supplementary signal producing means for producing based on said feedback control signal a supplementary signal for supplementing said basic fuel quantity signal, supplementary signal memorizing means for memorizing the supplementary signal, substituting means for substituting for the supplementary signal memorized in the supplementary signal memorizing means of a supplementary signal newly produced by the supplementary signal producing means, fuel supply control means for controlling the quantity of fuel supplied to the engine in accordance with the basic fuel quantity signal, with the feedback control signal and with the supplementary signal which is memorized in the supplementary signal memorizing means, control gain modifying means for decreasing the control gain from said control gain memorizing means in response to an increase in the number of times wherein supplementary signals are substituted for each other.

2. An air-fuel ratio control system in accordance with claim 1 in which said air-fuel ratio detecting means is an $O_2$ sensor located in an exhaust passage of the engine for detecting oxygen content in the engine exhaust gas.

3. An air-fuel ratio control system in accordance with claim 1 in which said supplementary signal producing means includes memory means for storing supplementary signals respectively for a plurality of discrete regions of an engine operating zone wherein feedback control is to be carried out.

4. An air-fuel ratio control system in accordance with claim 3 which further includes means for memorizing the numbers of times wherein the supplementary signals are produced, respectively for the discrete regions.

5. An air-fuel ratio control system in accordance with claim 1 in which said control gain modifying means includes means for steplessly decreasing the control gain.

6. An air-fuel ratio control system in accordance with claim 1 which further includes means for decreasing a count of the number of times wherein said supplementary signals are produced, when the air-fuel ratio signal is out of a predetermined range, to thereby increase the control gain.

7. An air-fuel ratio control system in accordance with claim 6 in which said last mentioned means includes means for decreasing the count for the number of times wherein said supplementary signals are produced when the air-fuel ratio signal is out of a predetermined range beyond a predetermined time.

8. An air-fuel ratio control system in accordance with claim 3 in which said air-fuel ratio detecting means is an $O_2$ sensor located in an exhaust passage of the engine for detecting oxygen content in engine exhaust gas, and means are provided for memorizing the numbers of times wherein the supplementary signals are produced, respectively for a plurality of discrete regions of an engine operating zone wherein feedback control is to be carried out.

9. An air-fuel ratio control system in accordance with claim 6 in which said air-fuel ratio detecting means is an $O_2$ sensor located in an exhaust passage of the engine for detecting the oxygen content in the engine exhaust gas, and last mentioned means including means for decreasing the count for the number of times wherein said supplementary signals are produced when the air-fuel ratio signal is out of a predetermined range.

* * * * *